United States Patent [19]

Tsuda et al.

[11] 4,253,760

[45] Mar. 3, 1981

[54] ELECTROPHOTOGRAPHIC APPARATUS FOR PRINTING MULTIPLE COPIES OF AN IMAGE ON A PHOTOSENSITIVE MEMBER

[75] Inventors: Hiroshi Tsuda, Mitaka; Kiyoshi Miyashita; Masaji Nishikawa, both of Hachioji; Akira Shimizu, Fuchu; Muneo Kasuga, Hachioji, all of Japan

[73] Assignee: Olympus Optical Co., Ltd., Tokyo, Japan

[21] Appl. No.: 30,627

[22] Filed: Apr. 16, 1979

[30] Foreign Application Priority Data

Apr. 18, 1978 [JP] Japan ..... 53-7803

[51] Int. Cl.[3] ..... G03G 15/00

[52] U.S. Cl. ..... 355/14 CU

[58] Field of Search ..... 355/14 CU, 14 R, 3 R; 235/925 B

[56] References Cited

U.S. PATENT DOCUMENTS 4,128,756 12/1978 Nagano et al. ..... 355/14 CU 4,163,897 8/1979 Habbard et al. ..... 355/14 CU

*Primary Examiner*—R. L. Moses

*Attorney, Agent, or Firm*—Haseltine and Lake

[57] ABSTRACT

An electrophotographic apparatus for forming any desired number of copies of a document from the same and single electrostatic charge latent image once formed on a photosensitive drum. The apparatus has a copy number set dial and a copy number counter for storing a desired copy number set by the dial. A control circuit for produces a load signal which serves to transfer the copy number set in the dial into the copy number counter. After the copy number has been transferred from the dial into the counter any desired copy number to be formed for a next document can be set in the dial. In a preferred embodiment the load signal is generated after a duplicating operation for a first copy has been initiated.

21 Claims, 17 Drawing Figures

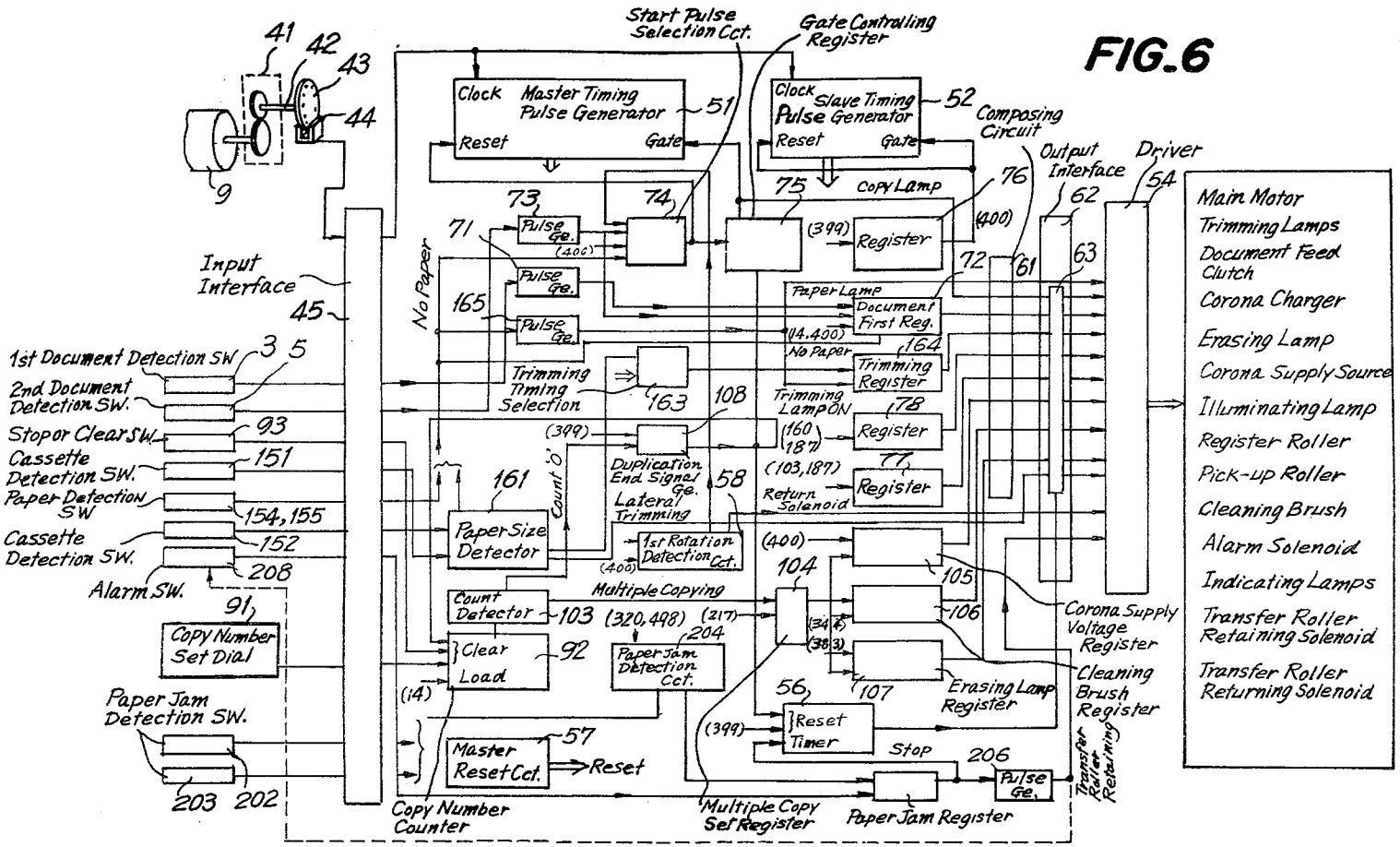
FIG.6
Main Motor
Trimming Lamps
Document Feed Clutch
Corona Charger
Erasing Lamp
Corona Supply Source
Illuminating Lamp
Register Roller
Pick-up Roller
Cleaning Brush
Alarm Solenoid
Indicating Lamps
Transfer Roller Retaining Solenoid
Transfer Roller Returning Solenoid
Driver
Output Interface
Composing Circuit
Gate Controlling Register
Start Pulse Selection Cct.
Clock Slave Timing Pulse Generator
Clock Master Timing Pulse Generator
Gate
Reset
Copy Lamp
Register
Paper Lamp
Document First Reg.
Trimming Register
Trimming Lamp ON
Return Solenoid
Corona Supply Voltage Register
Cleaning Brush Register
Erasing Lamp Register
Transfer Roller Retaining
Reset Timer
Stop
Pulse Ge.
Paper Jam Register
Multiple Copy Set Register
Duplication End Signal Ge.
Lateral Trimming
1st Rotation Detection Cct.
Multiple Copying
Paper Jam Detection Cct.
Trimming Timing Selection
Count 0
Paper Size Detector
Count Detector
Clear Load
Master Reset Cct.
Reset
Copy Number Counter
No Paper
Input Interface
1st Document Detection SW
2nd Document Detection SW.
Stop or Clear SW.
Cassette Detection SW.
Paper Detection SW
Cassette Detection SW.
Alarm SW.
Copy Number Set Dial
Paper Jam Detection SW.

ELECTROPHOTOGRAPHIC APPARATUS FOR PRINTING MULTIPLE COPIES OF AN IMAGE ON A PHOTOSENSITIVE MEMBER

BACKGROUND OF THE INVENTION

The present invention relates to an electrophotography, and more particularly to an electrophotographic apparatus which can form or print any desired number of duplicated copies for each of a plurality of documents or manuscripts in a speedy and simple manner.

In one type of such an electrophotographic apparatus any number of duplicated copies can be printed by successively repeating development and transferring steps for the same and single latent image which has been once formed on the photosensitive member by a single exposure-scanning of the document.

In another type of apparatus a primary electrostatic charge latent image is once formed on a photosensitive screen and any desired number of copies can be formed by successively repeating a step for forming a secondary electrostatic charge latent image on a record paper by means of a corona ion stream which is modulated by the primary electrostatic charge latent image on the screen, and a step for developing the secondary image with toner particles to form a visible toner image.

The electrophotographic apparatus of the kind mentioned above has an advantage that during the multiple duplication of a document a next document can be set in the apparatus. If it is required to form the same number of copies for successive documents, this copy number can be set in a copy number setting member such as a copy number dial, but is is intended to print different copies for successive documents, the copy number has to be changed. In general multiple copies are formed by multiple exposure-scanning for the single document and thus the document could not be exchanged by a next document. That is after the given number of copies have been printed the next document is set in the apparatus. Therefore a desired copy number to be obtained by the new document can be set by the copy number dial when the new document is set in the apparatus. However in the above mentioned multiple copying machine forming a plurality of copies from the single electrostatic charge latent image it is possible to set a next document while the desired number of copies for the present document are printed, and thus it is quite inconvenient to set a desired number of copies to be formed for the next document after the copies for the present document have been obtained.

SUMMARY OF THE INVENTION

The present invention has for its object to provide a novel and useful electrophotographic apparatus which can avoid the above mentioned inconvenience in setting a copy number to be formed for each document by allowing a setting a desired copy number during the duplicating operation for a previous document.

It is another object of the invention to provide an electrophotographic apparatus in which a desired copy number to be printed for a next document can be set in the apparatus when this next document is set in the apparatus, so that the duplicating operation for these copies can be initiated upon the completion of the duplicating operation for the previous document.

It is still another object of the invention to provide an electrophotographic apparatus in which the copy number which has been set in the apparatus can be changed even after the duplicating operation for a first copy of the related document has been initiated.

It is still another object of the invention to provide an electrophotographic apparatus in which the duplicating operation can be stopped at will upon a formation of a given number of copies which is smaller than the copy number which has been initially set in the apparatus.

According to the invention an electrophotographic apparatus for forming any desired number of copies from the same and single electrostatic charge latent image corresponding to a document comprises means for setting a desired copy number to be formed for a document;

means for storing the copy number set in said setting means; and means for producing a load signal is response to which the copy number which has been set in the setting means is loaded into said storing means; whereby after the copy number set in the setting means has been transferred into the storing means by said load signal any desired copy number to be printed for a next document can be set in said copy number setting means.

In a preferred embodiment of the invention the electrophotographic apparatus further comprises a clear or stop switch and when the clear switch is actuated by a user, the content in the copy number storing means is cleared.

BRIEF DESCRIPTION OF THE DRAWINGS

FIG. 6 is a detailed block diagram of a control device illustrated in FIG. 3;

DETAILED DESCRIPTION OF THE PREFERRED EMBODIMENTS

Figure 1:
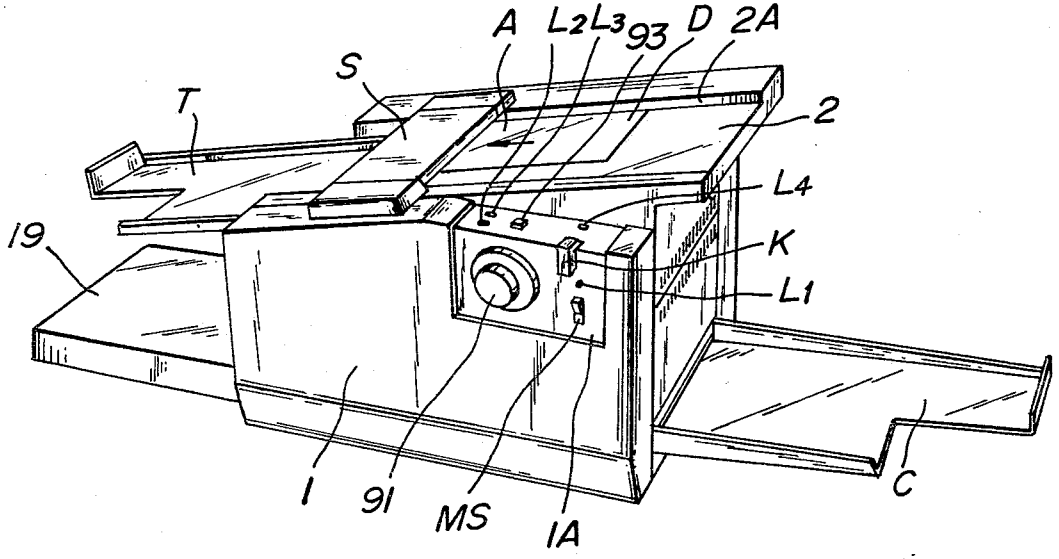
FIG. 1 is a perspective view illustrating an outer appearance of an embodiment of the electrophotographic apparatus according to the invention.

FIG. 1 shows an outer appearance of one embodiment of an electrophotographic apparatus according to the invention. Referring to FIG. 1, reference numeral 1 designates a main body or outer casing which is provided along its upper surface with a document feed path composed of a document carriage 2, light exposure portion S and detachable manuscript discharge tray T rectilinearly arranged in the order as mentioned above. A sheet like document D is disposed on the document carriage 2 and slidably moved toward the left as shown by an arrow A in FIG. 1. The sheet manuscript D is held between feed rollers in the light exposure portion S. The feed rollers cause the sheet manuscript D to pass through the light exposure portion at a given speed and discharge it onto the document discharge tray T. This document feed path is rectilinearly constructed as described above for the purpose of feeding the document without any trouble. In addition, in the present embodiment, the front end of the document feed path viewed in the advancing direction A of the document D is inclined downwardly for the purpose of effecting insertion and feed of the document in an extremely natural manner. The document carriage 2 is provided at its one side with an edge guide 2A extending along the advancing direction A of the document and determining not only the position of the sheet manuscript D to be inserted but also the position of a thick document carriage (not shown) and serving also as a guide for the sheet like document D. In case of duplicating a thick document such as a book the document is placed on the thick document carriage formed by a transparent plate and having racks along both side edges and the carriage is advanced along the document table 2, while a cover provided at the portion S being rotated over an angle of 180°.

The main body 1 is provided at its one side with an operation panel 1A including an electric source switch, i.e. main switch MS, dial 9 for determining the number of copies to be obtained, stop or clear button 93, light amount adjusting knob K and various kinds of display lamps $L_1$–$L_4$. The copy number setting dial 91 is rotated so as to set a desired number of copies (1 to 20 in the present embodiment) to be formed. The stop button 93 is pushed to stop the copying operation when it is started when the dial 91 is set to any erroneous number of copies. The light amount adjusting knob K is moved forwardly or backwardly so as to change the brightness of a fluorescent lamp (not shown) incorporated in the light exposure portion S and give a correct exposed light corresponding to the optical density of the manuscript D. The display lamp $L_1$ displays the ON state of the electric source switch MS, lamp $L_2$ absence of a record sheet in a paper cassette 19 to be described later, the lamp $L_3$ occurrence of jamming of the paper, and the lamp $L_4$ indicates start and end of the duplicating operation. A record paper cassette 19 encloses therein record papers each having a given size and superimposed one upon the other. The cassette 19 is detachably mounted on one end surface of the main body 1. If it is desired to change the size of the record sheet, another cassette enclosing record sheets having a desired size may be selectively mounted on the main body 1. The main body 1 is provided at that end surface which is opposed to the end surface on which is mounted the cassette 19 with a copy discharge tray C for receiving a copy. One end of the copy discharge tray C is rotatably supported by the opposed side surfaces of the main body 1 and the free end of the discharge tray C is rotated upwardly about its supporting shaft and releasably locked to the main body 1.

Figure 2:
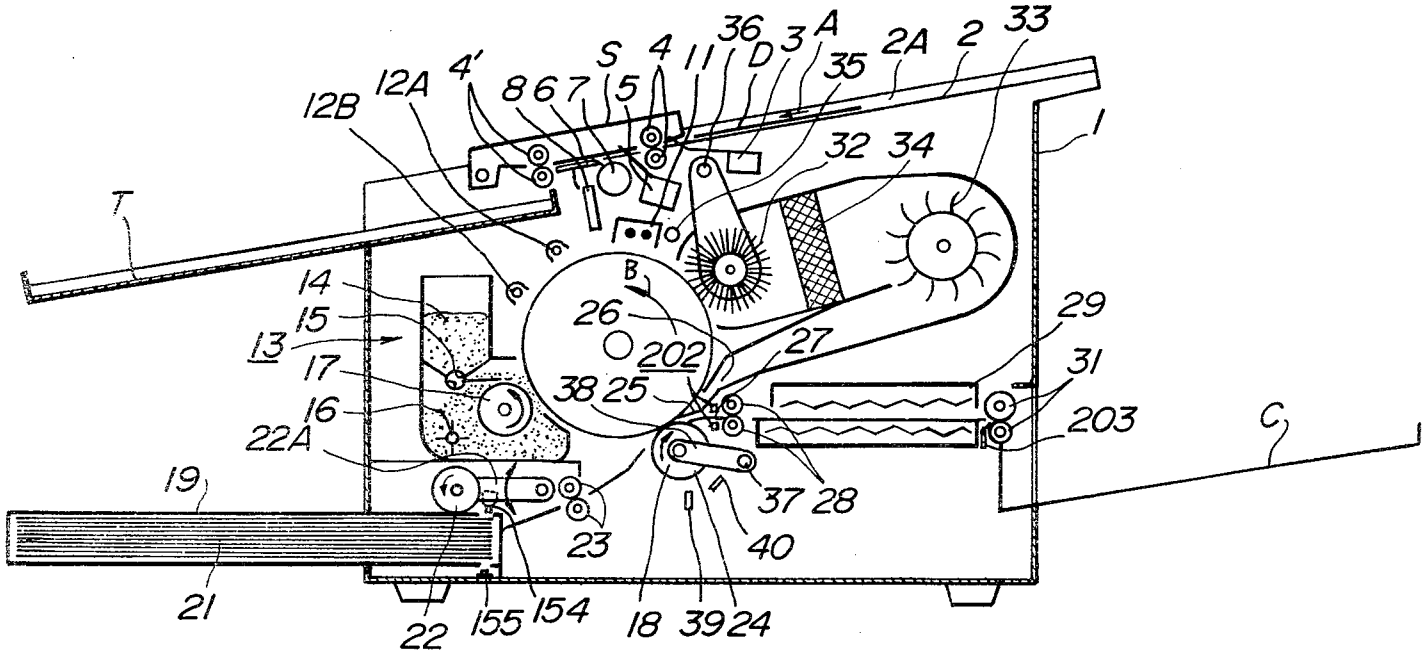
FIG. 2 is a schematic view showing an interior construction of the apparatus shown in FIG. 1.

FIG. 2 is a schematic view illustrating an interior construction of the electrophotographic apparatus shown in FIG. 1. As explained above the document D to be duplicated is inserted along the document table 2 from the right hand in FIG. 2 as shown by the arrow A. A front edge of the document D is detected by a first document detecting microswitch 3 having an actuator extending into the document feed path so as to drive two pairs of document feed rollers 4 and 4'. Then the document is advanced while being clamped between the first pair of feed rollers 4. While the document D advances in the direction A its front edge is detected by a second document detection microswitch 5 so as to produce a document detection signal which will be used as a basic or start signal for further sequential control. But is should be noted that any other signal than said document detection signal may be used as the basic signal for controlling various timings. The document D is further fed onto a transparent plate 6 at which it is exposed by an elongated light source 7. An image of the exposed document D is projected by means of an array 8 of optical fibers of converging type onto a surface of a photosensitive drum 9. The array 8 is aligned in a direction parallel to the width of the document D. The drum 9 comprises a photosensitive layer such as an Se layer and is rotated by a main motor (not shown) through a clutch in an anti-clockwise direction shown by an arrow B at a given peripheral velocity which is equal to the feeding speed of the document D. The photosensitive layer has been uniformly charged by a corona charger 11 with a grid to, for example, a positive 300–500 volts. Therefore an electrostatic charge latent image corresponding to the image of the document D is formed on the drum 9. Unnecessary charge on an area of the drum surface on which no document image is formed is erased by lateral and longitudinal trimming lamps 12A and 12B. These lamps also serve to erase undesired charge on the drum surface which will be deposited by a transferring roller in case of forming a plurality of copies from the single latent image, which will be explained later. The electrostatic latent image is developed with toner particles by a developing device 13. In this embodiment the developing device 13 comprises a toner reservoir 14, a knurled roller 15 for supplying a given amount of toner particles from the toner reservoir, an agitating vane 16 for mixing the toner particles with magnetic carriers and a magnet roller 17 for forming a toner brush. Such a developing device 13 per se has been well known as a magnetic brush developing device. The toner image thus formed on the drum 9 is then transferred onto a record paper 21 at a transferring section 18. The record paper 21 is supplied from the paper cassette 19 by means of a pick-up roller 22 rotatably supported by a swingable arm 22A and a pair of register rollers 23 which are driven in synchronism with the rotation of the drum 9 by means of a magnetically operating clutch (not shown). The transfer is carried out by means of a transfer roller 24. In order to effect the transfer without deteriorating the latent image on the drum 9 it is preferable to apply a transfer bias voltage of 500–700 volts to the transfer roller 24 which is made of resilient material having high resistivity. The record paper 21 on which the toner image has been transferred is then separated from the drum surface by means of a pair of peeling claws 25 arranged at both edges of the drum 9 and an air stream supplied through a duct 26 also serves to separate the paper 21 from the drum 9. The record paper 21 is then fed along a guide plate 27 and is further advanced by a pair of feeding rollers 28 into a fixing device 29 of an oven heater type. After the toner image has been fixed onto the paper the final duplicated copy is discharged on the copy discharge tray C by means of a pair of feeding rollers 31.

When it is not intended to print a plurality of copies from the same and single latent image, residual toners on the drum surface are removed by a rotating cleaning brush 32. Then the toners are sucked by an air stream caused by a fan 33 directly coupled to the main motor and are collected by a filter 34. In this embodiment the fan 33 is used to produce the air stream for peeling the paper from the drum 9. Then the electrostatic charge latent image is erased by an erasing lamp 35. In this manner a preparation for a next duplicating step has been completed.

On the contrary when a plurality of copies are to be formed from the same and single latent image once formed on the drum 9, the cleaning brush 32 is swingably moved away from the drum 9 about an axis 36 so as not to remove the residual toners on the drum 9 in order not to deteriorate the latent image. It is matter of course that the erasing lamp 35 should not be lighted on during the multiple duplication. By repeating the developing and transferring steps successively for the same latent image it is possible to form the visible toner images on successively supplied record papers so as to obtain a desired number of duplicated copies.

In the above explanation it is assumed that the record papers 21 are fed in a correct manner without any trouble. But when the paper is jammed on its travelling path, this should be detected to stop the duplicating operation. At the same time it is necessary to separate the transfer roller 24 from the drum 9 so as to make it easy to remove the jammed paper. To this end the transfer roller 24 is rotatably supported by an arm 38 which is moved swingably by energizing a pair of solenoids 39 and 40. Once the solenoid 39 has been actuated, the arm 38 is mechanically locked in position and thus the roller 24 is remained to be separated from the drum 9. In order to bring the roller 24 in contact with the drum 9 it is necessary to energize the return solenoid 40.

Figure 3:
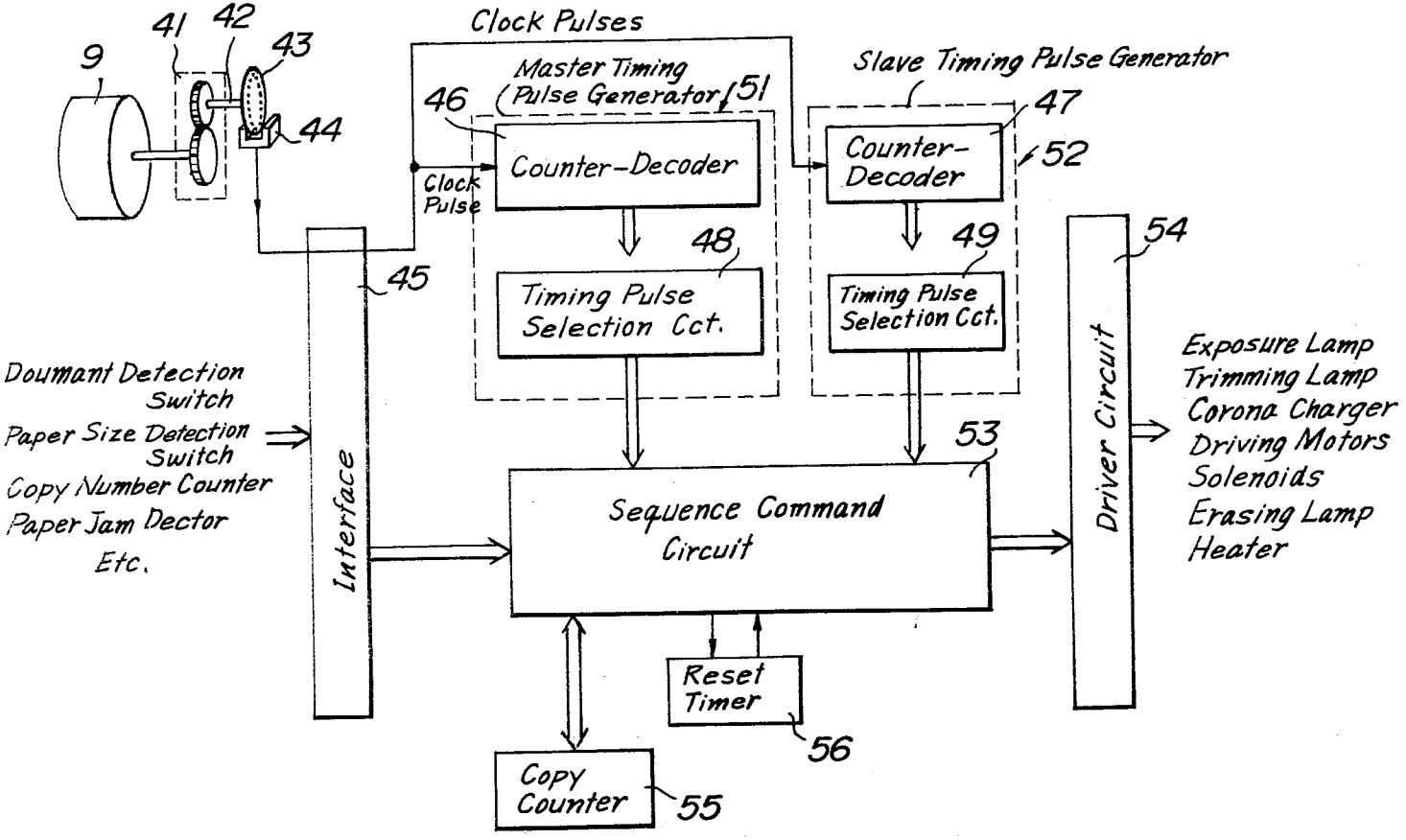
FIG. 3 is a schematic block diagram of a control device according to the invention.

Now a control device for controlling the operation of the apparatus as explained above under various conditions will be described. FIG. 3 is a schematic diagram illustrating a construction of the control device and how to generate clock pulses for use in the control device. In this embodiment a rotation speed of the photosensitive drum 9 is increased by sixteen times by means of a gear train 41 having a gear ratio of 16:1. To an output shaft 42 of the gear train 41 is coupled a disc 43 having formed therein fifty small apertures equidistantly along its periphery. There is further provided a photocoupler 44 having light emitting and receiving elements arranged on respective sides of the apertured disc 43. In this manner it is possible to produce a pulse series from the photocoupler 44 in response to the rotation of the drum 9. Waveform of pulses thus generated is reformed by an input interface 45 and then the pulse frequency is divided by two. Therefore during one revolution of the photosensitive drum 9 there are produced $50\times16\times\frac{1}{2}=400$ clock pulses. When a circumferential length of the drum 9 is made about 400 mm, the maximum error of control can be limited to about 1 mm measured along the circumference of the drum 9. If a larger number of clock pulses are generated during a single rotation of the drum 9, the maximum error could be further decreased and thus more accurate control could be expected. However when consider accuracy necessary for the electrophotographic apparatus, it is sufficient to produce 200–800 clock pulses per revolution of the drum 9.

In the present embodiment these clock pulses are counted by counter-decoders 46 and 47. Count values of these counter-decoders are supplied to timing pulse selecting circuits 48 and 49, respectively which select given clock pulses as timing pulses for controlling the operation of various devices of the copying machine.

Figure 4:
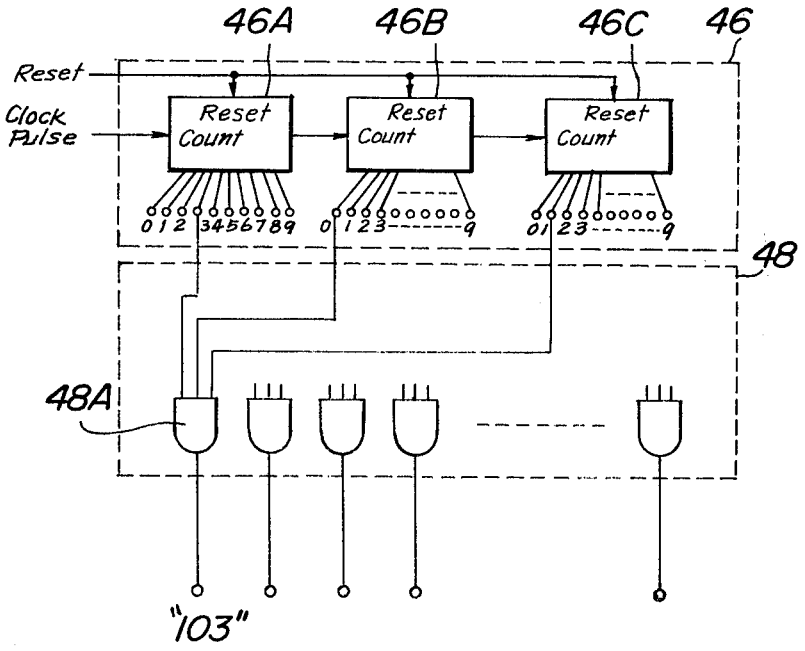
FIG. 4 is a block diagram showing an embodiment of a counter decoder and timing pulse selecting circuit.

FIG. 4 is a block diagram showing a construction of the counter-decoder 46 and timing pulse selecting circuit 48. The counter-decoder 46 comprises three decimal counter-decoders 46A, 46B and 46C connected in series and thus can count decimal numbers up to three digits (999), but in this embodiment its counting operation is limited to 400 count. The timing pulse selecting circuit 48 comprises a number of AND gates having inputs connected to given outputs of the counter-decoder 46. For example the AND gate 48A has three inputs connected to a fourth output "3" of the first digit decoder 46A, a first output "0" of the second digit decoder 46B and a second output "1" of the third digit decoder 46C. Therefore the AND gate 48A produces at its output a timing pulse "103" when the decoder 46 has counted 103 clock pulses. The counter-decoder 47 comprises two decimal counter-decoders connected in series and thus can count 0–99 clock pulses. The timing pulse selection circuit 49 comprises a plurality of AND gates having input terminals connected to given outputs of the decoder 47. Hereinafter a combination of the counter-decoder 46 and the timing pulse selecting circuit 48 is termed as a master timing pulse generator 51 and a combination of the counter-decoder 47 and timing pulse selection circuit 49 as a slave timing pulse generator 52. According to the invention it is essential to provide at least two timing pulse generators 51 and 52, which will be explained in detail hereinafter.

The control device further comprises a sequence command circuit 53 which receives various timing pulses from the timing pulse generators 51 and 52 and produces various control signals for controlling the operation of various devices. To this sequence command circuit 53 are also supplied through the interface 45 or directly various signals such as the document detection signals from the switches 3 and 5, a paper size detection signal, a paper detection signal, a copy count signal, a paper jam detection signal, etc. In this embodiment since the sequence command circuit 53 is composed of a random logic of TTL the interface circuit 45 serves to convert the above mentioned signals supplied from the mechanical switches, photosensor, etc. into signals having a given TTL level. The control signals formed by the command circuit 53 are supplied to various motors, solenoids, corona charger, lamps, heater, etc. by means of a driver circuit 54. A reference numeral 55 denotes a counter for setting and counting the number of copies and a reference numeral 56 a timer a function of which will be explained later in greater detail.

Now the reason why two timing pulse generators 51 and 52 are provided will be explained. According to the invention in order to increase efficiency of the operation, duplicating operation for a second or next document can be started before the duplicating operation for a first document has been completely finished. In case of using the endless photosensitive member of seamless type it is possible to initiate the duplicating operation for the second document at any time as soon as the duplicating operation for the first document could never be effected. In this case parts of the two duplicating operations for the first and second documents, respectively are carried out simultaneously. Particularly in case of using the seamless photosensitive member there is no definit relation with respect to timings between these two duplicating operations and thus it is necessary to control these two operations simultaneously as well as independently. Therefore according to the invention a pair of timing pulse generators 51 and 52 have to be provided. Such a control can be carried out by providing two independent timing pulse generators each of which can produce all control pulses necessary for controlling the whole duplicating operation. But in practice, an end portion of the duplicating operation for the first document is performed simultaneously with a start portion of the duplicating operation for the second document and thus a time period during which the two operations are carried out simultaneously is relatively short. Therefore it is surplus to provide the two completely independent timing pulse generators. Thus in the present embodiment the whole duplicating operation is divided into two portions and each of the divided portions is assigned to respective generator. That is to say the master timing pulse generator 51 serves to control the first portion of the duplicating operation and then the control is taken over by the slave timing pulse generator 52 which can control the remaining portion of the duplicating operation. Then after the control has been transferred to the slave timing pulse generator 52 the master timing pulse generator 51 can be initiated at any time instance. It should be noted that the start timing of the master timing pulse generator 51 is limited by a progress of the duplicating operation for the first document. Since a portion of the latent image of the first document to be further developed should not be erased the duplicating operation for the second document should not be started at a too early time instance. In this embodiment the duplicating operation for the second document is initiated at a time when the drum 9 has rotated over one revolution from the start of control for the duplicating operation of the last copy for the first document. It is noted that the control for the last copy should be taken over by the slave timing pulse generator 52 at that time.

In the present embodiment the whole duplicating operation is effected during about one and quarter revolution of the drum 9. As explained above when the timing for taking over the control from the master timing pulse generator 51 to the slave timing pulse generator 52 is made as faster as possible, the efficiency becomes increased. However in this embodiment in order to utilize the timing pulses commonly to the single duplication and to the multiple duplication so as to make the circuit construction as simple as possible, the taking over of the control is effected after the drum has rotated over one revolution. Since the circumferential length of the drum 9 is slightly longer than the maximum length of the record paper 21 the duplication can be started immediately after the control is taken over and thus a relatively short waiting time can be attained.

Figure 5:
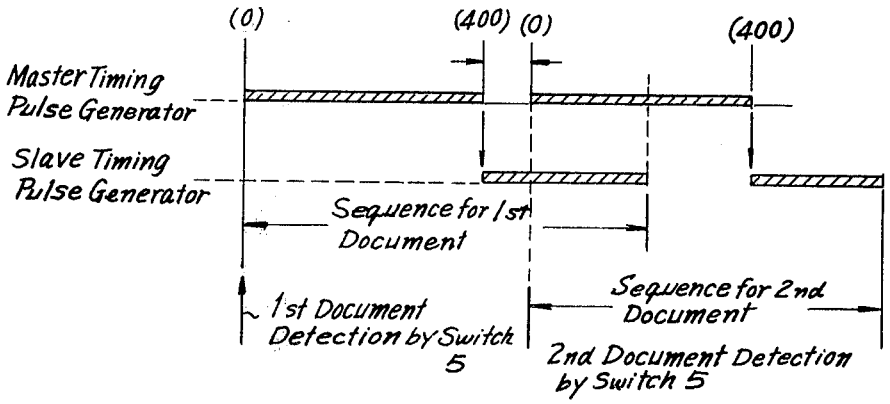
FIG. 5 is a timing chart for taking over the control from a master timing pulse generator to a slave timing pulse generator.

FIG. 5 shows schematically how to assign the sequential control to the master and slave timing pulse generators 51 and 52. As illustrated in FIG. 5 the control for the duplication of the second document is started after the taking over of the control from the master generator 51 to the slave generator 52 with a certain interval t.

When consider the operation for multiple duplication, it is always necessary to start a duplication operation for a next copy after the duplicating operation for a first copy has been completed, i.e. after one revolution of the drum. Thus in this case the change over of the control from the master generator 51 to the slave generator 52 should be effected before the beginning of the duplication for the next copy. That is to say the time period during which the master timing pulse generator 51 serves to control the operation should be equal to one revolution period of the drum 9. Under the above circumstances in the present invention the master timing pulse generator 51 is designed to effect the control during one rotation of the drum 9. By this measure in case of effecting the multiple duplication the master timing pulse generator 51 can be repeatedly actuated without an interval each time the drum 9 rotates over one revolution and thus the construction of the control device can be made simple.

FIG. 6 is a detailed block diagram of the control device shown in FIG. 3. Now a detailed operation of various portions will be explained also with reference to the drawings. In the drawings a numerical value described in a round bracket denotes a timing pulse number for controlling the relevant circuit. By means of the control device the corona charger 11, the erasing lamp 35, the trimming lamps 12A, 12B, the pick-up roller 22, the register roller 23, the cleaning brush 32, etc. are to be controlled. In the control device there are provided a number of registers each of which is assigned to control respective one of control items mentioned above. These registers are controlled by the timing pulses and control signals which are produced in response to the document detection signal, the paper jam detection signal, the paper size detection signal, the paper existence detection signal, etc. The control device also produces signals for controlling the operation of the timing pulse generators 51 and 52.

Figure 7:
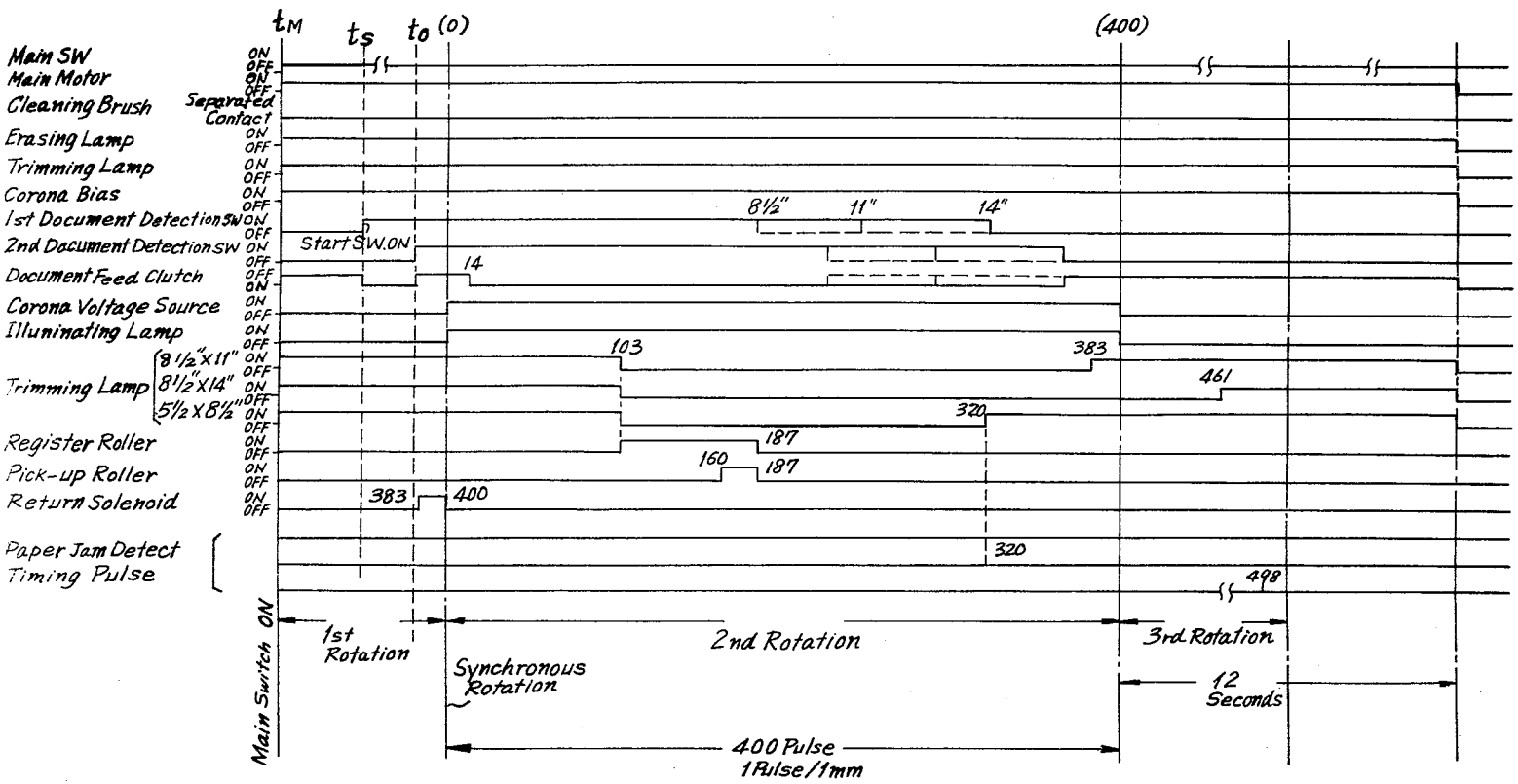
FIG. 7 is a timing chart for illustrating the control for the single duplication.

FIG. 7 is a timing chart for controlling the apparatus in case of the single duplication. When the power switch, i.e. the main switch MS (FIG. 1) is made ON at a timing $t_M$, a master reset circuit 57 is actuated. The master reset circuit 57 is to reset the registers provided in the control circuit and the various circuits are set to desired initial state. At the same time a reset timer 56 is actuated and a gate 63 provided in an output interface circuit 62 is made conductive for twelve seconds. It should be noted that the timer 56 is so constructed that it is set again every time the duplication is carried out and thus the gate 63 is remained conductive as long as the duplicating operation continues. While the timer 56 is operating the main motor for driving the drum 9, the cleaning fan 33, etc., a bias supply source for the transferring roller 24, the developing device 13, the paper pick-up roller 22, the paper feed rollers 28 and 31 are made always operative. An electric heater of the fixing device 29, a bias voltage supply to the grid of the corona charger 11, a voltage supply source for the control circuit and a motor for driving a cooling fan (not shown) are made operative irrespective of the timer 56 while the main switch MS is actuated. Therefore the drum 9 begins to rotate upon the actuation of the main switch MS at $t_M$. Then the apertured disc 43 is also rotated and the photocoupler 44 generates the clock pulses which are supplied to the timing pulse generators 51 and 52 as explained before. Since these generators 51 and 52 are reset by the master reset circuit 57 the counter-decoder 46 in the master timing pulse generator 51 begins to count the clock pulses from a zero count. In the reset condition the cleaning brush 32 is made in contact with the drum 9 and the erasing lamp 35 is made lighted on. Thus during the rotation of the drum 9 possible residual toners on the drum are cleaned by the brush 32 and any electrostatic charge on the drum is also erased by the erasing lamp 35.

As explained above since the timer 56 operates for twelve seconds if other operation is not ordered by a user, the drum 9 continues to rotate for twelve seconds and the photosensitive member is cleaned by the brush 32 and any electrostatic charge thereon is erased by the lamp 35. In usual use such cleaning and erasing operations have been effected at the end of the last duplicating operation and thus are not necessary to be repeated upon the actuation of the main switch MS. However if the power supply is interrupted by any reason or the paper jam is detected, the cleaning and charge erasing could not be effected. Thus in this embodiment the cleaning and charge erasing operations are carried out every time the main switch MS is made ON. If the paper has been remained in the apparatus, it is also discharged upon the actuation of the main switch. If any document to be duplicated is not inserted into the apparatus during the twelve seconds, the gate 63 in the interface 62 is made blocked so as to light off the erasing lamp 35. At the same time the main motor, the corona supply source, the developing bias voltage supply source, the transferring bias voltage supply source, etc. are all made inoperative.

The conduction of output gates of the timing pulse generators 51 and 52 is controlled by output gate controlling registers 75 and 76, respectively. The initiation or reset timing of the timing pulse generators 51 and 52 is controlled by a start pulse selecting circuit 74. When the master timing pulse generator 51 has counted 400 clock pulses, the master timing pulse generator 51 is initiated to count the clock pulses. Therefore it is important at what timing should the master timing pulse generator 51 initiate. In this embodiment the master timing pulse generator 51 is started to count the clock pulses when the second document detection switch 5 is actuated by the front edge of the document D. On the other hand the duplication for the second document should not be initiated before the drum 9 has rotated over one revolution after the beginning of the previous duplication. When the second document detection switch 5 is actuated before the drum has rotated over one revolution, it is preferable to delay the initiation of the new duplicating operation until the completion of one rotation of drum 9. Particularly in case of the multiple copying such a measure is essential. In the present embodiment the start pulse selection circuit 74 determines or judges which timing should be used as a starting timing the document detection timing from the switch 5 or the completion timing of one revolution of drum (a timing pulse (400) from the master timing pulse generator 51).

Now return to the timing $t_M$ at which the main switch MS is made ON. An output from the master reset circuit 57 causes to actuate a first rotation detecting circuit 58 which produces a signal during the first revolution of the drum 9 after the actuation of the main switch MS. This circuit 58 has two functions, i.e. a first function is to block the output gates of the master timing pulse generator 51 by means of the start pulse selecting circuit 74 and a gate controlling circuit 75 and a second one is to energize the transfer roller returning solenoid 40 through the output interface 62. When the transfer roller 24 has been separated from the drum 9, it will be made in contact with the drum. For this purpose timing pulses (383) and (400) are directly supplied to the first revolution detecting circuit 58 with bypassing the output gates of the master timing pulse generator 51. That is to say the return solenoid 40 is energized by the timing pulse (383) and the output gates of the master timing pulse generator 51 are remained blocked until the timing pulse (400) is generated. The returning of the transfer roller 24 is effected near the end of the first rotation of the drum 9, because after the drum has been cleaned by the cleaning brush 32, the transfer roller is made in contact with the drum so as to prevent the residual toners on the drum from being stuck onto the roller 24.

After the first rotation of the drum 9 the blocking condition of the output gates of the master timing pulse generator 51 is released and thus the duplication could be started. When the document D is inserted from the direction A (see FIGS. 1 and 2), the first document detection switch 3 detects the front edge of the document at a timing $t_s$ in FIG. 7 and then a pulse generator 71 produces a pulse which sets a document feed register 72. Then the register 72 drives a document feed clutch by means of a mixing circuit 61, the interface 62 and a driver 54. In this manner the document D is further advanced, and its front edge is detected by the second document detection switch 5 at a timing $t_o$. Then a pulse generator 73 produces a pulse. At the same time the document feed rollers 4 are stopped for a moment. The pulse generated from the generator 73 is supplied to the start pulse selection circuit 74. The circuit 74 judges whether the paper cassette 19 is set in position, the papers are set in the cassette, the previous duplication is carried out, etc. If the new duplication can be started, the master timing pulse generator 51 is reset by said pulse from the pulse generator 73 and at the same time the gate controlling register 75 is controlled by the same pulse to control the output gates in the generator 51. It should be noted that in the example shown in FIG. 7 during the first revolution of the drum 9 the document is detected by the second switch 5, the selection circuit 74 is so controlled by the first rotation detecting circuit 58 that the output gates of the generator 51 are blocked until the completion of the first rotation of drum, and thus any timing pulse is not generated from the generator 51. On the contrary when the circuit 58 has detected the first rotation of the drum, the duplicating operation is initiated as soon as the second document detection switch 5 detects the document edge. During the duplicating operation the lamp $L_4$ for indicating the under duplication is made lighted on through the driver circuit 54, etc.

Figure 8:
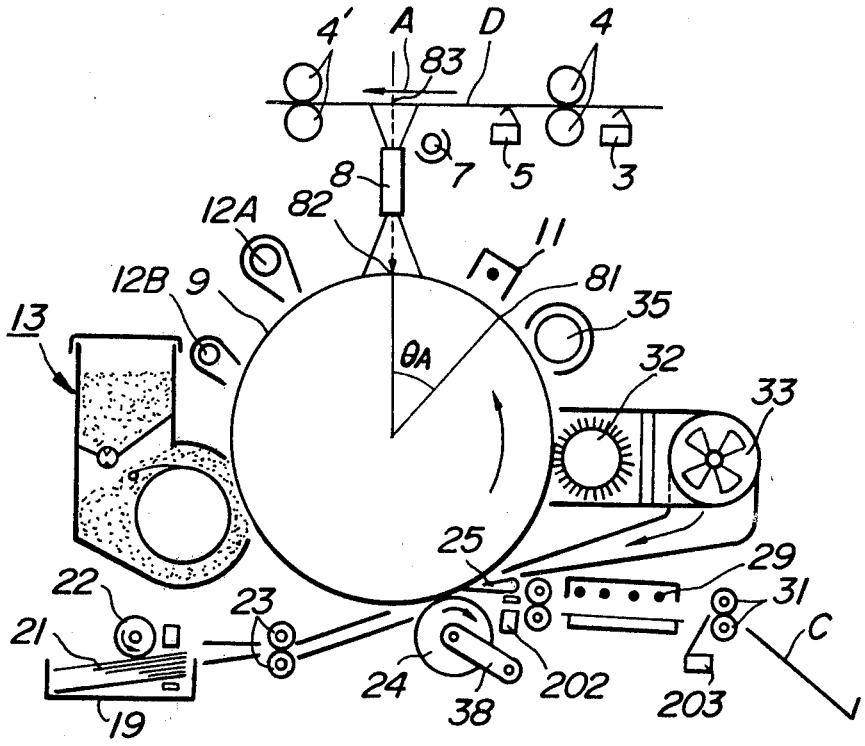
FIG. 8 is a schematic view of the apparatus shown in FIGS. 1 and 2 for explaining the duplicating operation.

Now the duplicating operation will be explained with reference to the time chart shown in FIG. 7 and a schematic view illustrated in FIG. 8. At first the voltage supply to the corona charger 35 and illuminating lump 7 is carried out at the timing pulse (0) and then the document feed rollers 4 and 4' are driven again at a timing pulse (14). As illustrated in FIG. 8 the document feed rollers 4 and 4' are actuated at such a timing that a point 81 on the drum 9 from which the drum is uniformly charged by the corona charger 35 reaches an exposing point 82 just when the front edge of the document D comes at an illuminating position 83. This is effected in this embodiment by initiating the advance of the document at the timing pulse (14). That is the drum 9 rotates over an arc $\theta_A$ during said time period. It should be noted that the drum 9 is rotated as long as the main motor rotates. The feed rollers 4 may be stopped when the switch 5 is made OFF, i.e. the rear edge of the document passes through the switch 5, while the document feed rollers 4' are remained operative. When a timing pulse (399) is generated almost at the end of the rotation of the drum 9, this pulse is supplied to a register 76 which makes the output gates in the slave timing pulse generator 52 conductive and the generator 52 is reset at the timing pulse (400). Then the slave timing pulse generator 52 beings to count the clock pulses up to 99 pulses and generates a timing pulse (461) for energizing the longitudinal trimming lamp 12B and a timing pulse (498) for detecting a paper jam. The remaining operation during the duplication could be easily understood from the time chart shown in FIG. 7 and thus need not be explained further in detail. But the operation at the end of duplication will be described hereinafter in greater detail. In FIG. 6 a reference numeral 77 denotes a register for driving the register rollers 23 and 78 a register for controlling a swinging movement of the pick-up roller supporting arm 22A. It should be noted that the timer 56 is so constructed that it is refreshed by the timing pulse (399) and thus if the duplication is repeatedly effected, the timer 56 is made always operative.

The one of the objects of the invention is to provide a useful electrophotographic apparatus which can form copies of successive documents with a minimum waiting time. Particularly in known apparatuses of low speed type if the photosensitive drum is not seamless and the operation is controlled with respect to a standard point (start point) fixedly determined on the drum, there is a waiting time between the successive duplications up to the one rotation period of the drum in order to maintain the synchronism between the advance of document and the rotation of drum. In this embodiment use is made of the drum of seamless type and no standard point is determined on the drum 9. In order to attain the above mentioned object it is necessary that the duplication for the next document can be started before the duplication for the first document has not been finished completely. Since the photosensitive member is expensive it is preferable to use the photosensitive drum as small as possible. Then the whole duplicating operation for the single copy could not be completed during the single rotation period. Therefore if only one timing pulse generator is provided, the new duplicating operation for the next document could not be initiated even though the drum has rotated over one revolution and is in a condition for allowing a formation of a new electrostatic charge image. In this embodiment in order to avoid such a disadvantage there are provided the two timing pulse generators and during the duplication of the first document under the control of one generator the new duplication for the next document can be initiated under the control of the other generator.

Figure 9:
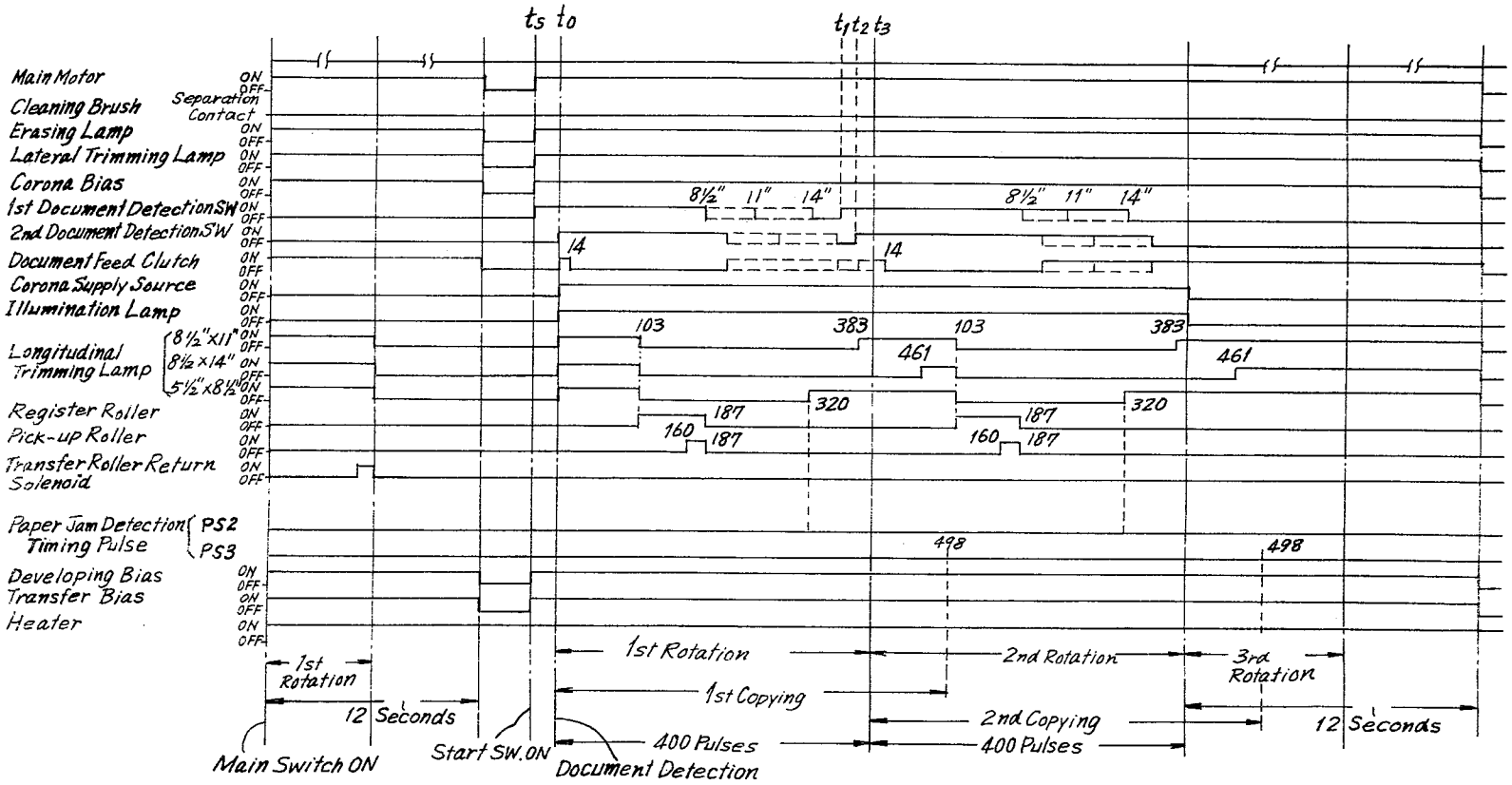
FIG. 9 is a time chart for explaining the duplicating operation for successive documents.

FIG. 9 is a time chart for explaining the duplicating operation for successively supplied documents. As explained later the apparatus of this embodiment can operate for three kinds of record papers. At first the front edge of the first document is detected by the first document detection switch 3 at a timing $t_s$ so as to drive the document feed rollers 4 and 4' and then the second document detection switch 5 detects the same document edge. In this explanation the drum 9 has been rorated more than the first revolution after the main switch MS was actuated. When the second switch 5 detects the document at a timing $t_o$, the master timing pulse generator 51 is immediately initiated so as to start the duplicating steps. Then the duplication is carried out in the same manner as explained with reference to FIG. 7. When the drum 9 has just rotated over one revolution, i.e. the timing pulse (400) is generated, the control for the first document is taken over from the master timing pulse generator 51 to the slave timing pulse generator 52. When the generator 52 produces the timing pulse (98), the duplicating operation for the first document is finished. However in this embodiment the second document is detected by the first document detection switch 3 at a timing $t_1$ immediately after the discharge of the first document. Then the document feed clutch is actuated and the second document is further advanced. At a timing $t_2$ the second document detection switch 5 detects the front edge of the second document. Then the pulse generator 73 produces a pulse as explained hereinbefore. However since the start pulse selection circuit 74 does not detect the timing pulse (400) supplied from the master timing pulse generatot 51, that is to say the drum 9 has not yet rotated over one revolution, the output gates of the master timing pulse generator 51 are not reset by said pulse. Thus the duplication for the second document is not initiated, but the duplication for the first document is made continued without interruption. At a timing $t_3$ the timing pulse (400) is generated and the master timing pulse generator 51 is reset thereby and the duplicating step for the second document is initiated under the control of the master timing pulse generator 51. At the same time the duplicating operation for the first document is controlled by the slave timing pulse generator 52. In this manner the duplicating operations for the first and second documents are carried out simultaneously so as to make a waiting time minimum.

Figure 10:
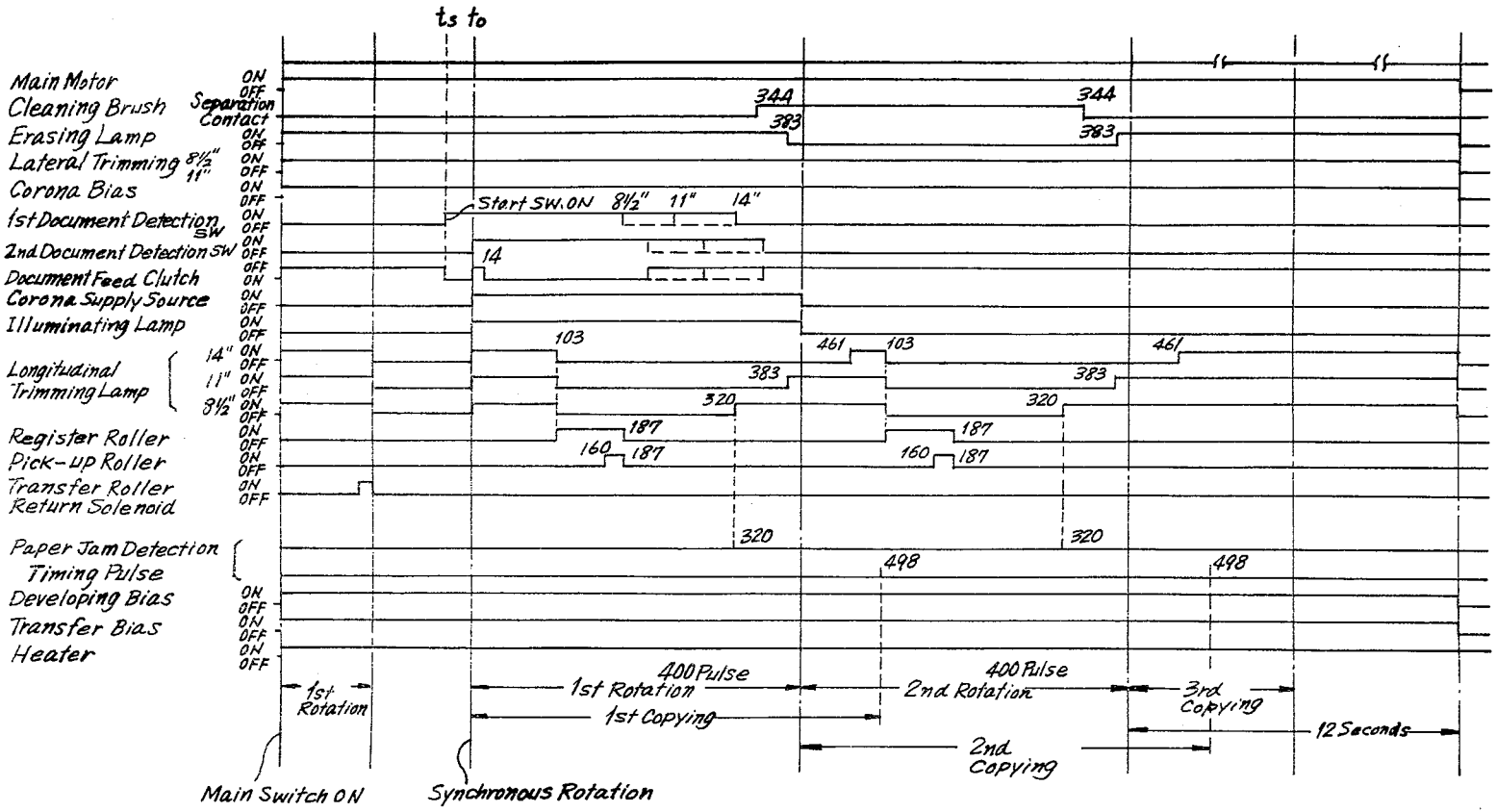
FIG. 10 is a time chart for explaining the multiple duplicating operation.

Next the operation for the multiple copying will be explained with reference to a time chart depicted in FIG. 10. At first the given desired number of copies is set by the copy number set dial 91 provided on the operation panel 1A. When the timing pulse (14) is generated after the initiation of the duplicating step, the count value set in the dial 91 is transferred to a copy number counter 92 and loaded therein. This loading may be preferably delayed until a timing pulse (217) will appear, because in this case the copy number can be changed after setting, but before loading.

In order to stop the duplication after loading the copy number into the counter 92 there is provided the clear switch, i.e. the stop switch 93 which can clear the content of the counter 92 upon being depressed.

Figure 11:
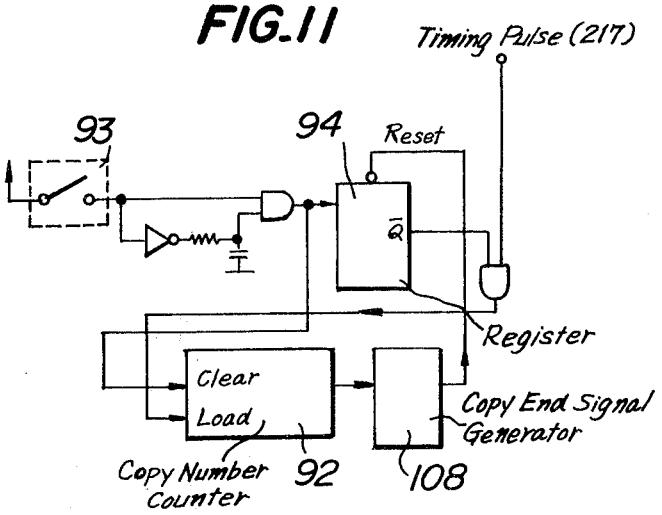
FIG. 11 is a block diagram showing an embodiment of a copy number clearing circuit.

FIG. 11 is a block diagram showing an embodiment of the copy number clearing circuit. When the clear switch 93 is actuated, the content of the copy number counter 92 is cleared and at the same time a register 94 is set. The load signal, i.e. the timing pulse (217) is gated off by $\overline{Q}$ output of the register 94. Therefore after the clear switch 93 has been depressed the copy number which is still set in the dial 91 could not be loaded again into the counter 92 even if the timing pulse (217) is supplied. The register 94 will be reset by a duplication end signal generator 108.

When the clear switch 93 is not actuated, the content in the counter 92 is decreased by one each time a timing pulse (320) is generated. To the counter 92 is also connected a detector 103 which detects whether or not the copy number set by the dial 91 is larger than one. When the copy number set in the dial 91 is more than two, the detector 103 sets a multiple copy set register 104. This setting operation is carried out by the timing pulse (217). Then steering of master-slave flip-flops provided in a corona supply voltage register 105, a cleaning brush register 106 and an erasing lamp register 107 is controlled in such a manner that the cleaning brush 32 is separated from the drum 9 upon a timing pulse (344), the erasing lamp 35 is lighted off upon a timing pulse (383) and the power supply to the corona charger 11 is cut off upon the occurrence of the timing pulse (400). Therefore the electrostatic charge latent image once formed on the photosensitive drum 9 is not erased and a plurality of copies can be printed by repeating the development and transferring steps for the remained latent image. If the copy number dial 91 is set to two, the content of the counter 92 is decreased to one at a start of the second rotation of the drum 9 and this is detected by the detector 103 so that the multiple copy set register 104 is reset by the timing pulse (217). As the result the steering of the registers 105, 106 and 107 is so controlled that the cleaning brush 32, the erasing lamp 35 and the corona charger 11 are driven into the initial condition at the timing pulses (344), (383) and (400), respectively. When the content of the counter 92 becomes zero at the timing pulse (320), the duplication end signal generator 108 resets the control register 75 at the timing pulse (399) so as to block the output gates of the master timing pulse generator 51 and thus a new duplicating step is not initiated. The output from the duplication end signal generator 108 refreshes the reset timer 56 and thus the drum 9 will stop after rotating for twelve seconds. This situation can be equally applied to the single duplicating operation.

As explained above the copy number set in the dial 91 is loaded into the counter 92 and the content of the counter is decreased one by one each time a single copy is formed. Therefore during the duplication for the plurality of copies the desired copy number for the next document can be previously set in the dial 91 after the content in the dial has been transferred into the counter 92.

Next operation and control upon two abnormal conditions will be explained. One of the abnormal conditions is non-existence of the record paper in the cassette 19 and the other is the paper jam. If a record paper is not set in the cassette 19 or the cassette is not completely inserted into the apparatus, the preparation for the duplication such as the cleaning of the drum, etc. is effected upon the actuation of the main switch MS, but the document feed is never carried out even if the front edge of the document is detected by the first document detection switch 3. The complete insertion of the cassette 19 into the apparatus is detected by means of two microswitches and the papers in the cassette are detected by a photoelectric switch.

Figure 12A:
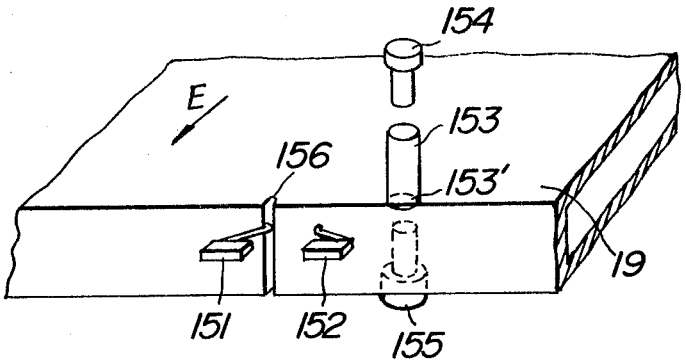
FIGS. 12A and 12B are perspective and plan views illustrating an embodiment of a cassette and paper detecting switches.
Figure 12B:
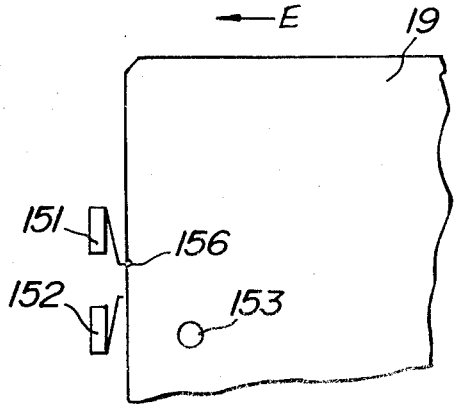

FIGS. 12A and 12B are perspective and plan views, respectively illustrating these switches. Microswitches 151 and 152 are arranged at such positions that when the cassette 19 is completely inserted from a direction shown by an arrow E, both the microswitches are actuated by the front side wall of the cassette. The cassette 19 has formed apertures 153 and 153' in its major surfaces, respectively. When the cassette 19 is completely inserted in position, the aperture 153 will face a light emitting element 154 and the aperture 153' will be opposite to a light receiving element 154. If no record paper is set in the cassette 19, light emitted from the element 154 reaches directly the element 155 so as to detect the non-existence of paper. When the non-existence of the cassette and/or paper in the cassette is detected, the microswitches 151 and 152 and/or the element 155 disable the start pulse generator 74 and thus the generator 74 does not produce a pulse for driving the master timing pulse generator 51. In this manner the duplication can be inhibited under the above mentioned abnormal condition.

In this embodiment the microswitches 151 and 152 have function to detect the paper size. To this end the side wall of the cassette 19 has formed therein a recess 156 into which an actuator of the microswitch 151 will be inserted. Another cassette for setting another record paper of different size has a recess which will accommodate an actuator of the other microswitch 152 and still another cassette for still different size paper has no recess. In this manner three combinations of ON and OFF conditions of the microswitches can distinguish three different paper sizes.

Figure 13:
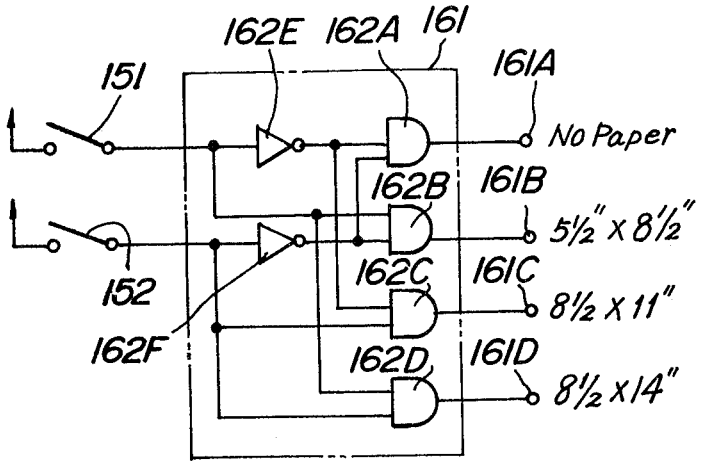
FIG. 13 is a circuit diagram depicting an embodiment of a paper size detecting circuit.

FIG. 13 is a circuit diagram of an embodiment of a paper size detecting circuit 161 comprising AND gates 162A–162D and inverters 162E and 162F. In this embodiment it is possible to use any one of three kinds of papers, i.e. 13.97×21.59 cm (5.5×8.5 inches), 21.59×27.94 cm (8.5×11 inches) and 21.59×35.56 cm (8.5×14 inches). If the microswitch 151 is not actuated, but the microswitch 152 is actuated, a signal is generated at an output terminal 161C through the AND gate 162C, said signal indicating that the record papers of 8.5×11 inches are set in position. If the casette 19 is not completely or correctly inserted into the apparatus a signal will appear at an output 161A from the AND gate 162A through the inverters 162E and 162F. The output signal from the circuit 161 is supplied to a trimming timing selection circuit 163 which then controls a trimming register 164 in such a manner that the longitudinal trimming lamp 12L is lighted ON and OFF at suitable timings in accordance with the detected paper size. The lateral trimming lamp 12A will be lighted on only when the paper of 5.5×8.5 inches is detected.

Figure 14:
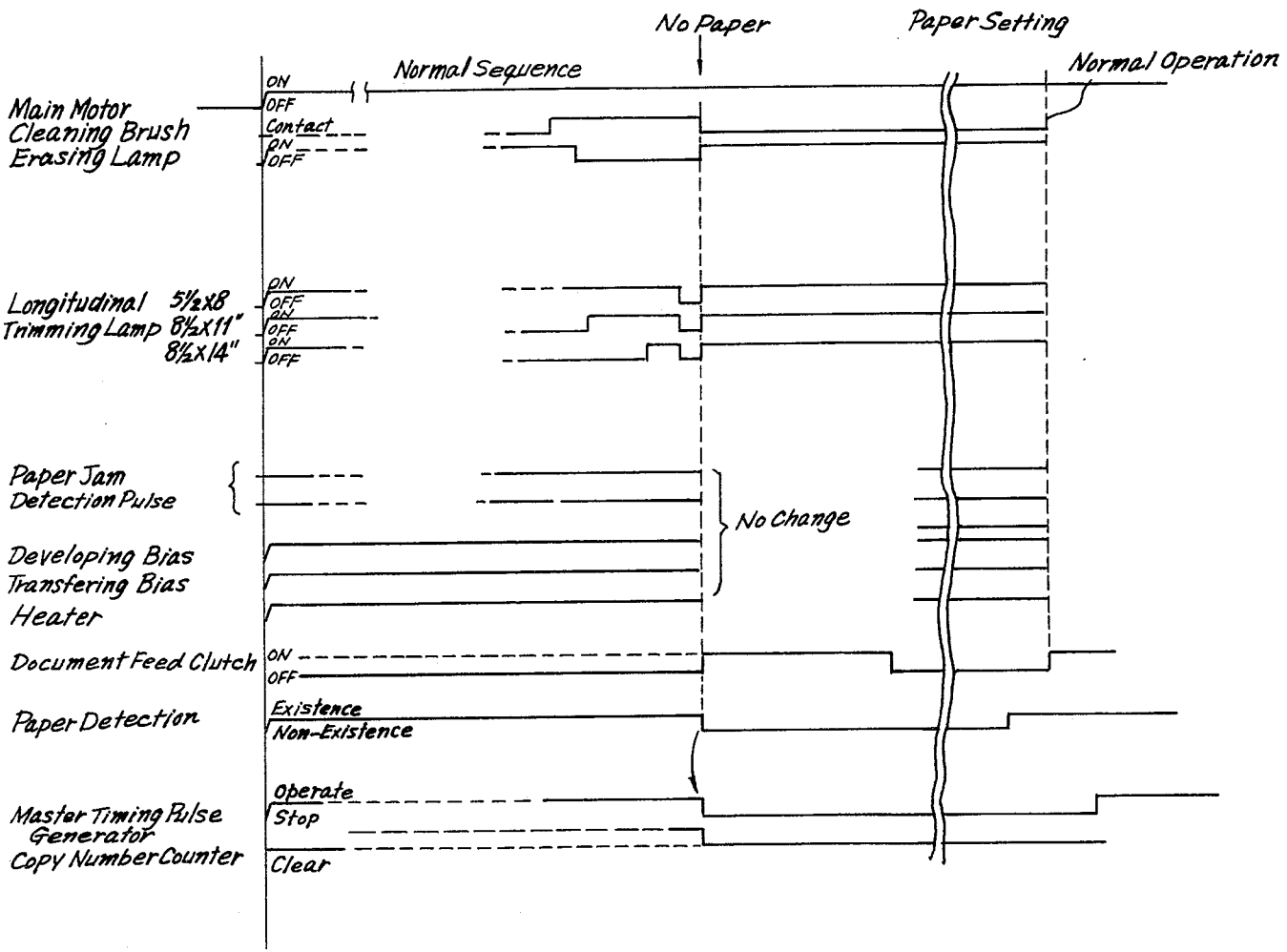
FIG. 14 is a time chart for explaining the operation upon detection of non-existence of paper.

During the duplicating operation when all of the record papers are discharged from the cassette 19, the apparatus will operate as shown in a time chart shown in FIG. 14. As explained above in such an occasion a signal for indicating non-existence of the paper is produced from the photoelectric element 155 which is supplied to the start pulse selection circuit 74. Then the circuit 74 inhibits a generation of a next sequence start pulse and thus a new duplication could not be carried out any more. At the same time the longitudinal trimming lamp 12B is made continuously lighted on through a pulse generator 165 and the lamp L2 for indicating the non-existence of paper in the cassette is lighted on. Also the copy number counter 92 is cleared. Since when the non-existence of paper in the cassette 19 is detected, the control for the related duplication has been transferred to the slave timing pulse generator 52, the remaining duplicating operation is carried out as usual. As explained above the longitudinal trimming lamp 12B is lighted on and thus the electrostatic charge image on the drum 9 is erased and thus toner particles are not adhered to the transfer roller 24. In this embodiment even if the duplication for the next document has been initiated when the non-existence of the paper is detected, an electrostatic charge latent image corresponding to a portion of the document can be erased by the longitudinal trimming lamp 12B. However according to the design or construction of the apparatus the detection timing might be too late to erase completely the electrostatic charge image of the next document by the longitudinal trimming lamp 12B. In such a case special erasing means may be provided after the trimming lamp 12B, but before the developing device 13 viewed in the rotational direction of the drum 9. Since the operation of the master timing pulse generator 51 is stopped upon the detection of the no-paper condition, the duplicating step for the next document which has been already started could be stopped. The pick-up roller 22 is separated from the cassette 19 so that the cassette may be withdrawn from the apparatus without being disturbed by the pick-up roller 22. Further the last paper which is passing through the toner image transfer section 18 can be discharged correctly by inhibiting a paper jam detection circuit which will be explained later. As a case may be the copy number counter 92 may not be cleared even if the non-existence of paper is detected. In this case the remaining number of copies can be obtained after the cassette 19 in which new papers have been set is inserted into the apparatus and the duplicating operation is started again. It should be noted that if the non-existence of paper is detected during the multiple duplication, the document feed rollers 4, 4' are driven. Therefore if the next document has been set into the apparatus, it will be discharged without being duplicated. To this end the document feed register 72 is set by the detection signal of the no-paper condition. In this case the document feed rollers 4, 4' may be driven in reverse direction so that the document is discharged on the document table 2. By means of such a measure a next duplication can be easily started and further the operator can positively be aware of the occurrence of abnormal condition. If the document which has been set is not discharged upon the detection of the no-paper condition, this document will be duplicated first upon a start of a new operation. Therefore remaining copies of the first document have to be duplicated again. Then copies of the first and second documents are mixed with each other.

Figure 15:
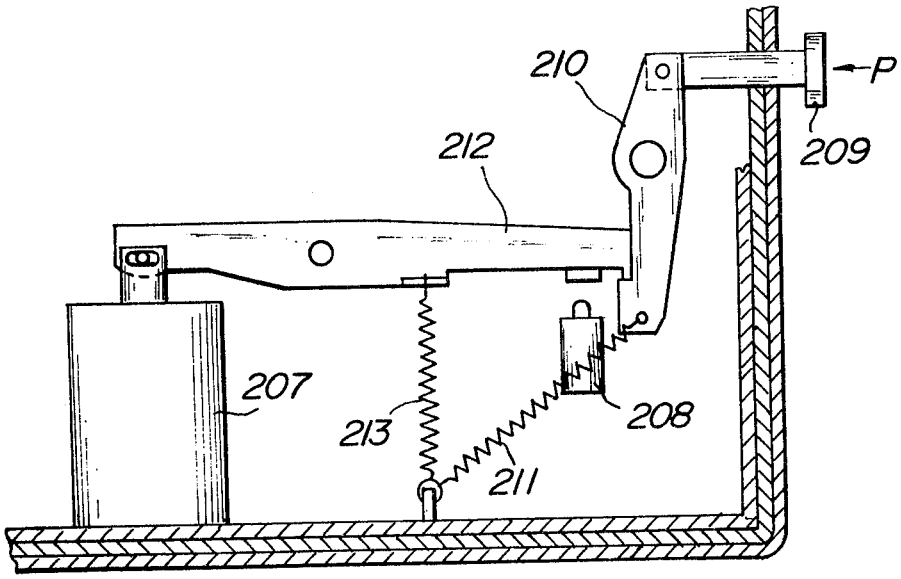
FIG. 15 is a side view showing a locking and releasing mechanism of an alarm switch.
Figure 16:
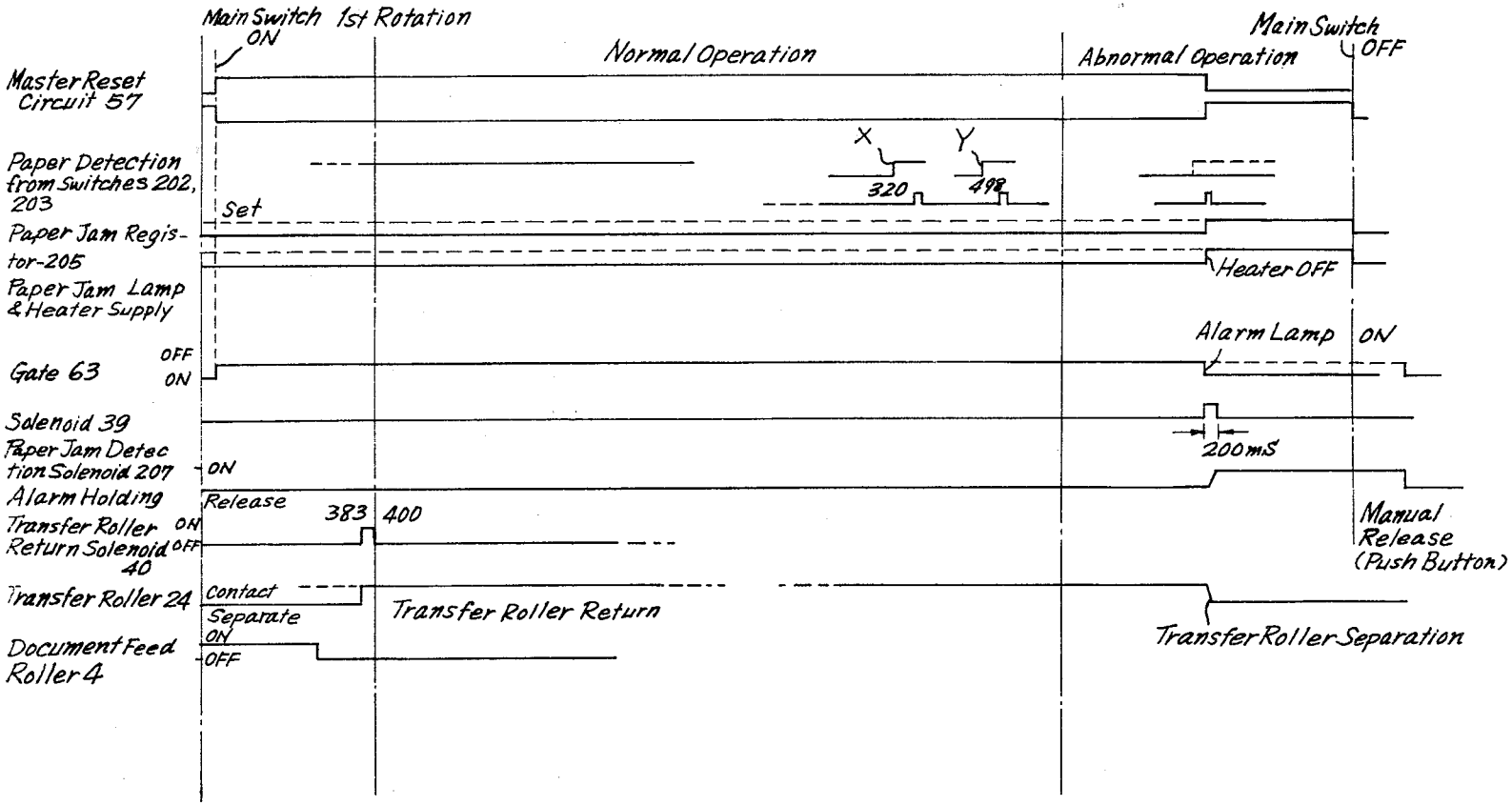
FIG. 16 is a time chart for explaining the operation upon detection of paper jam.

Next an operation upon detection of paper jam will be explained with reference to FIGS. 15 and 16. There are arranged two paper-jam detection switches 202 and 203 as illustrated in FIG. 2. In this embodiment the switch 202 is a photoelectric switch and the other switch 203 is a microswitch. Output signals from these switches are supplied to a paper jam detection circuit 204. When the record paper 21 is fed normally, the output signals form the switches 202 and 203 raise at timings X and Y as shown in FIG. 16. Timing pulses (320) and (498) for detecting the paper jam are generated slightly after these timings X and Y. These timing pulses are supplied to the paper jam detecting circuit 204 to be gated out by the output signals from the switches 202 and 203. Therefore if the paper advances correctly, any one of the timing pulses is not produced from the circuit 204. On the contrary if the paper is not correctly fed and the output signals from the switches do not raise at the correct timings X and Y, the timing pulse (320) or (498) appears at the output of the paper jam detection circuit 204 and thus the paper jam register 205 is set by the timing pulse. When the register 205 is set, a pulse generator 206 produces an output for 0.2 seconds, which energizes the solenoid 39. Thus the transfer roller 24 is separated from the drum 9, so that the jammed paper could be easily withdrawn from the apparatus. The transfer roller 24 is kept in this refrained position until the transfer roller return solenoid 40 is energized. At the same time the output signal from the pulse generator 206 energizes a paper jam detection solenoid 207 so as to make an alarm switch 208 on. The on condition of this switch 208 is mechanically locked. In order to release this condition it is necessary to push an alarm release button 209 as shown in FIG. 15. When the alarm switch 208 is made on, the paper jam register 205 is remained to be set. Thus if the main switch MS is made on after being once made off, the paper jam register 205 is remained to be set. Also the output signal of the register 205 is supplied to the reset timer 56 so as to inhibit its operation, the gates provided in the output interface 62 are made blocked, and thus the voltage supply to the main motor, corona charger, illuminating lamp, fixing heater, etc. is cut off. At the same time the register 205 makes the paper jam indicating lamp L3 lighted on.

In order to recover the normal condition of the apparatus after the detection of the paper jam the following steps have to be taken. At first the main switch MS is made off the the jammed paper is removed from the apparatus. Then the button 209 is pushed in a direction P in FIG. 15 so as to release the mechanical lock of a lever 210 against a force of spring 211. Then a lever 212 rotates in a clockwise direction due to a force of a spring 213 and thus the alarm switch 208 is made off. Thereafter the main switch MS is actuated again. Then the solenoid 40 is energized and the transfer roller 24 is made again in contact with the drum 9. It should be noted that if the document is set at the second document detection switch 5, the document is discharged without duplication upon the actuation of the main switch. To this end the document feed register 72 is set by the master reset circuit 57. On the contrary if the document has been set at the first document detection switch 3, the normal duplication step is effected upon the actuation of the main switch MS as explained before with reference to FIG. 7. Alternatively the document which has been stopped at the given position after actuating the switch 5 may be remained as it is and the duplication for this document may be initiated upon the actuation of the main switch MS after one rotation of the drum 9. However in such a case it is necessary to provide a detector for distinguishing the above mentioned two situations.

When the power supply is accidentally interrupted, the operation of the whole apparatus is naturally stopped. Thus it is important how to control the apparatus when the electric supply is recovered. In this embodiment when the power supply is recovered, the master reset circuit 57 operates and the various devices operate in the same manner as explained in connection with the paper jam. If the record paper is remained in the duplication path, it is discharged during the first rotation of the drum 9.

Figure 17A:
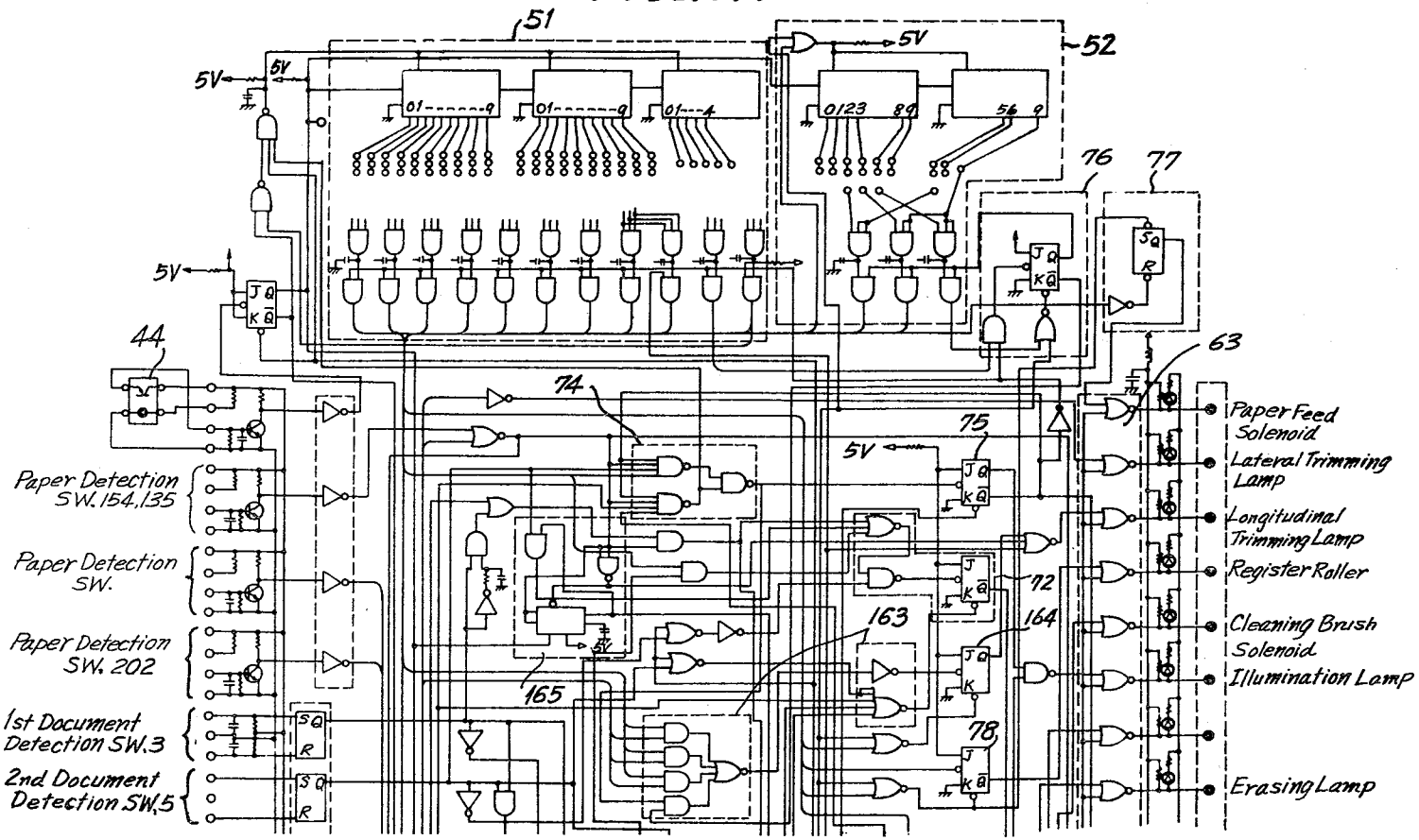
FIGS. 17A and 17B are block diagrams showing detailed construction of a control device.
Figure 17B:
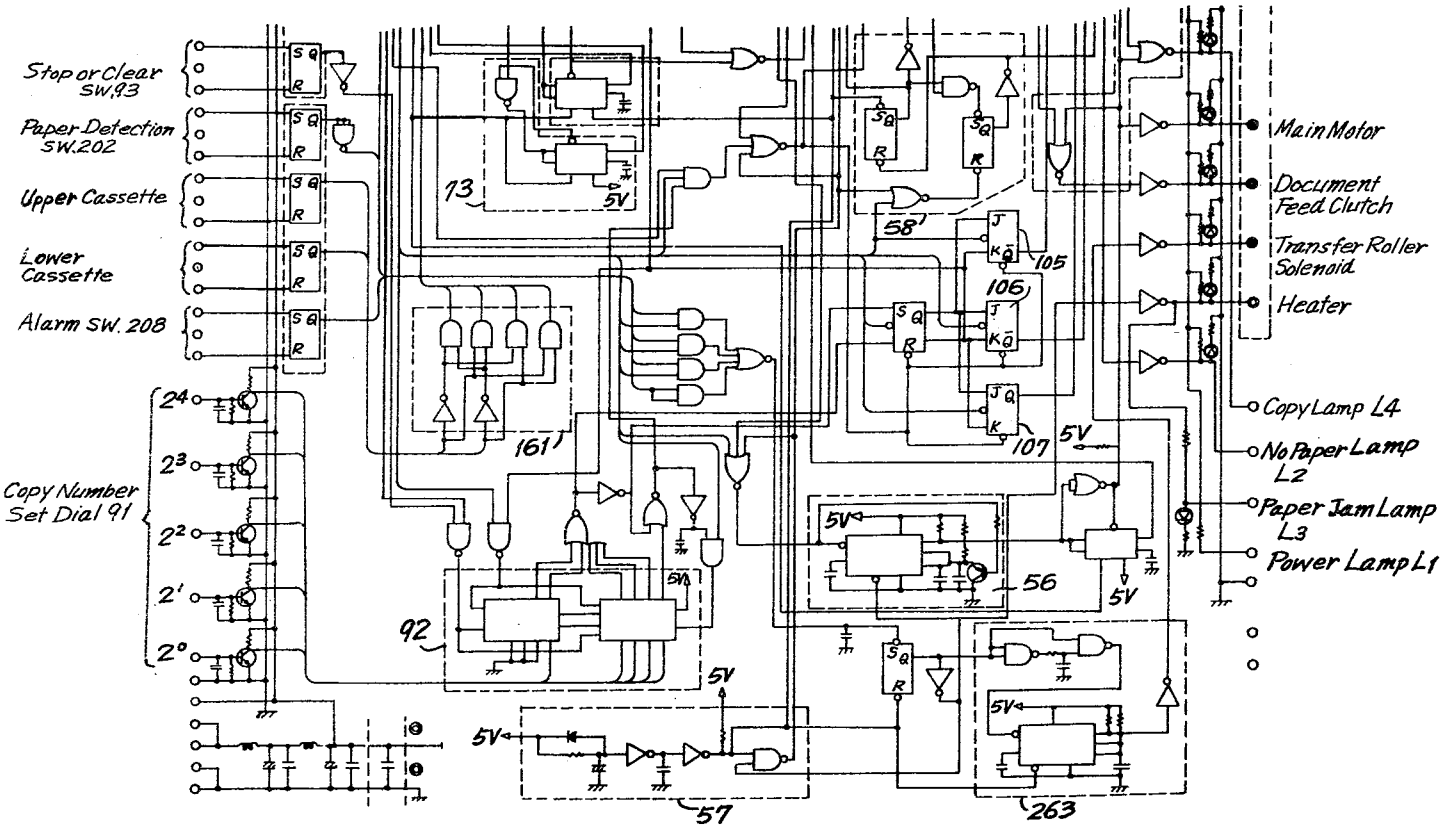

FIGS. 17A and 17B are block diagrams showing in detail the control circuit illustrated in FIG. 6. Since the function of the control circuit has been explained fully the detailed explanation of the construction of the control circuit shown in FIGS. 17A and 17B is deleted. It should be noted that the whole circuit construction could be understood by placing the drawing of FIG. 17A just above the drawing of FIG. 17B.

It should be noted that the present invention is not limited to the embodiments explained above, but many modifications could be conceived within the scope of the invention. In the above embodiment the control for the whole duplicating operation is divided into two portions and these positions are assigned to the master and slave timing pulse generators. But there may be provided a pair of timing pulse generators each of which can produce whole timing pulses necessary for forming a copy and these timing pulse generators are made operative in an alternate manner with being overlapped partially.

In the above embodiment the photosensitive apparatus comprises the sheet like document feeding mechanism, but the apparatus may comprise a movable document table or a movable optical system instead of the sheet feed mechanism. In the above explained embodiment the first document detection switch 3 is used as a print start switch, but a print start button may be provided instead of the first document detecting swtich. Further the photosensitive member may be constructed by a photosensitive screen, a photosensitive belt, etc. Moreover the counting of the duplicated copy number may be carried out in various ways. For instance, the copy number set in the dial 91 may be loaded into the copy number counter 92 at an earlier or later timing than the timing pulse (217).

Further in the above embodiment the clock pulses are produced by the rotation of the drum 9, but the drum may be rotated in synchronism with clock pulses supplied from a clock pulse generator. According to the invention it is sufficient that the clock pulses are produced in synchronism with the rotation of the drum, i.e. each clock pulse is generated when the drum rotates over a given angle. It should be noted that in the apparatus which can effect the multiple duplication the said given angle should be equal to such a value that a quatient obtained by dividing 360° by said angle becomes an integer number, otherwise the generation of clock pulses could not be synchronized with the drum, i.e. the movement of electrostatic charge latent image.

In the above mentioned embodiment the master timing pulse generator 51 is made operative when the second document detection switch 5 detects the front edge of the document and the document is advanced at the fixed timing pulse (14). However it is preferable to make variable a time period from the start of the timing pulse generator to the advance of the document. It is quite difficult to place precisely the document at a given position when it actuates the switch 5 and the position of document at such timing varies in accordance with respective apparatus. Therefore the travelling of document might be out of synchronization with respect to the operation of various parts and thus a correctly duplicated copy might not be obtained. If the time period from the actuation of the switch 5 to the start timing of the advance of document can be adjusted, it is possible to compensate the above mentioned variations in timing without changing the operational timings of various parts nor displacing the position of the switch 5. In the above embodiment the timing pulse generator is composed of the counter decoders and AND gates, but it may be formed by BCD, a combination of binary counters and 4–10 line decoders, a shift register, a program logic array (PLA), a combination of memory (ROM) and counter. Further in the embodiment explained above the control device is formed as random logic, but may be composed in such a manner that more than two duplicating steps which are carried out in parallel can be controlled by a microprocessor.

What is claimed is:

1. An electrophotographic apparatus for forming and desired number of copies from the same and single electrostatic charge latent image corresponding to a document comprising a photosensitive member arranged movably;

means for driving the photosensitive member;

means for substantially uniformly charging the photosensitive member;

means for projecting an image of a document onto the charged photosensitive member to form an electrostatic charge latent image;

means for developing the latent image with toner particles to form a toner image;

means for transferring the toner image onto a record paper;

means for setting a desired copy number to be formed from the electrostatic charge latent image once formed on the photosensitive member;

means for storing the copy number set in said setting means;

means for producing a load signal in response to which the copy number set in the setting means is loaded into said copy number storing means; and means for controlling the operation of the driving means, charging means, projecting means, developing means and transferring means in accordance with the copy number stored in the copy number storing means;

whereby after the copy number has been transferred from the setting means into the copy number storing means, any desired copy number to be formed for a next document can be set in the copy number setting means.

2. An electrophotographic apparatus according to claim 1, wherein said load signal is produced in response to a given timng pulse which is generated after the start of the duplication for a first copy, whereby the copy number can be altered even after the duplicating operation for forming the first copy has been started, but before the occurrence of said timing pulse.

3. An electrophotographic apparatus according to claim 2, further comprising a clear member for producing a clear signal which clears the content in the storing means.

4. An electrophotographic apparatus according to claim 3, further comprising means for storing the clear signal so as to prevent the load signal which will be produced after the actuation of the clear member from being supplied to the copy number storing means.

5. An electrophotographic apparatus according to claim 4, wherein said copy number storing means comprises a down counter the content of which is subtracted one by one each time a copy is formed.

6. An electrophotographic apparatus according to claim 5, further comprising a copy end detecting circuit for detecting the zero count of the counter to produce a copy end signal.

7. An electrophotographic apparatus according to claim 6, wherein said clear signal storing means comprises a register having a set input terminal connected to receive the clear signal from said clear member, a reset input terminal connected to receive the copy end signal from the copy end detecting circuit, and an output terminal connected to a gate for selectively passing the load signal, whereby the register is reset by said copy end signal to enable the gate to pass the load signal and is set by the clear signal to disable the gate.

8. An electrophotographic apparatus according to claim 2, further comprises means for generating clock pulses having a given period;

at least two timing pulse generators for receiving the clock pulses to produce various timing pulses including said given timing pulse in synchronism with the duplicating operation; and means for receiving the timing pulses to produce various control signals for controlling the duplicating operation, whereby said at least two timing pulse generators are made operative independently from each other and during the duplicating operation of a document under the control of the timing pulses produced by one timing pulse generator the generation of timing pulses from the other timing pulse generator can be initiated for controlling the duplicating operation for a next document.

9. An electrophotographic apparatus according to claim 8, wherein each of said at least two timing pulse generators can produce all of timing pulses necessary for controlling the complete duplicating operation for forming a single duplicated copy.

10. An electrophotographic apparatus according to claim 8, wherein the complete duplicating operation for forming a single duplicated copy is divided into a plurality of sequential portions and each of said portions is assigned to respective timing pulse generator.

11. An electrophotographic apparatus according to claim 10, wherein there are provided master and slave timing pulse generators and the control for the duplicating operation for forming a single copy is taken over from the master timing pulse generator to the slave timing pulse generator.

12. An electrophotographic apparatus according to claim 11, further comprising means for detecting a setting of a document in the apparatus to produce a document detection signal and a start pulse selection circuit for initiating the generation of the timing pulses from the master timing pulse generator in response either to said document detection signal or to a given timing pulse produced by the master timing pulse generator when said taking over of the control is effected.

13. An electrophotographic apparatus according to claim 11, wherein the control for the duplicating operation for forming the single copy is taken over from the master timing pulse generator to the slave timing pulse generator and after that the duplicating operation for a next copy can be carried out under the control of the master timing pulse generator, which can produce all of timing pulses necessary for controlling the apparatus during one period of the movement of photosensitive member.

14. An electrophotographic apparatus according to claim 13, wherein said photosensitive member comprises a rotatable photosensitive drum and said master timing pulse generator produces the timing pulses which are necessary for controlling the operation of the apparatus during one rotation of the drum.

15. An electrophotographic apparatus according to claim 14, wherein the period of the clock pulse is so determined that substantially 200 to 800 clock pulses, preferably 400 clock pulses are generated during one rotation of the drum.

16. An electrophotographic apparatus according to claim 14, wherein a time period necessary for forming a single copy is determined to be substantially equal to one and quater rotations of the drum, and said given timing pulse for producing the load signal is generated during the one rotation of the drum.

17. An electrophotographic apparatus according to claim 14, wherein said means for producing the clock pulses comprises a rotating disc having formed therein a plurality of apertures along its peripheral portion, mechanical linkage for driving the disc in synchronism with the drum, and a photocoupler having light emitting and receiving elements arranged on respective side of the disc.

18. An electrophotographic apparatus according to claim 13, wherein each of said master and slave timing pulse generators comprises counter decoder including a plurality of counter stages for counting the clock pulses and having a number of output terminals and timing pulse selecting circuit including a plurality of AND gates having input terminals connected to given output terminals of the counter stages.

19. An electrophotographic apparatus according to claim 13, further comprising means for detecting an existence on the record paper at a record paper storing section to produce a no-paper signal, and means in response to said no-paper signal for stopping a new sequence of duplication control to be initiated during the execution of duplicating operation for the last record paper.

20. An electrophotographic apparatus according to claim 13, further comprising means for detecting paper jam to produce a paper jam signal and said control device is so constructed that the duplicating operation is instantaneously stopped in response to said paper jam signal.

21. An electrophotographic apparatus according to claim 20, wherein said transferring means comprises a transfer roller which is made separated from the photosensitive member in response to said paper jam signal.

* * * * *

UNITED STATES PATENT AND TRADEMARK OFFICE

CERTIFICATE OF CORRECTION

PATENT NO. : 4,253,760

DATED : March 3, 1981

INVENTOR(S) : TSUDA ET AL

It is certified that error appears in the above-identified patent and that said Letters Patent are hereby corrected as shown below:

Under FOREIGN APPLICATION PRIORITY DATA amend

"53-7803" to read --54-7803--

Signed and Sealed this

*Twenty-seventh* Day of *October 1981*

[SEAL]

*Attest:*

GERALD J. MOSSINGHOFF

*Attesting Officer*

*Commissioner of Patents and Trademarks*